US009412325B2

(12) United States Patent
Xue et al.

(10) Patent No.: US 9,412,325 B2
(45) Date of Patent: Aug. 9, 2016

(54) ARRAY SUBSTRATE AND DRIVING METHOD THEREOF

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Hailin Xue, Beijing (CN); Yubo Xu, Beijing (CN); Cheng Li, Beijing (CN); Xiaochuan Chen, Beijing (CN); Xin Li, Beijing (CN); Shunshun Qiu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 89 days.

(21) Appl. No.: 14/281,000

(22) Filed: May 19, 2014

(65) Prior Publication Data

US 2014/0253607 A1 Sep. 11, 2014

Related U.S. Application Data

(62) Division of application No. 13/242,061, filed on Sep. 23, 2011, now Pat. No. 8,767,022.

(30) Foreign Application Priority Data

Sep. 30, 2010 (CN) ..... 2010 1 0502072

(51) Int. Cl.
*G09G 5/10* (2006.01)
*G09G 3/36* (2006.01)

(52) U.S. Cl.
CPC ..... *G09G 3/3685* (2013.01); *G09G 3/3648* (2013.01); *G09G 2310/0205* (2013.01)

(58) Field of Classification Search
CPC ..... G09G 3/3614
USPC ..... 345/690
See application file for complete search history.

(56) References Cited

U.S. PATENT DOCUMENTS

2005/0168490 A1* 8/2005 Takahara ..... G09G 3/2014 345/690
2006/0291233 A1 12/2006 Kwon
(Continued)

FOREIGN PATENT DOCUMENTS

CN 101079227 A 11/2007
CN 101458429 A 6/2009
CN 101546056 A 9/2009

OTHER PUBLICATIONS

Chinese Intellectual Property Office Rejection Decision dated Mar. 4, 2013; Appln. No. 20100502072.8.
Third Chinese Office Action dated Sep. 22, 2013; Appln. No. 201010502072.8.
USPTO RR dated Aug. 13, 2013 in connection with U.S. Appl. No. 13/242,061.
(Continued)

*Primary Examiner* — Temesgh Ghebretinsae
*Assistant Examiner* — Kwin Xie
(74) *Attorney, Agent, or Firm* — Ladas & Parry LLP

(57) ABSTRACT

An array substrate is provided comprising a base substrate; an array of pixel electrodes formed on the base substrate; a plurality of gate lines, each of which is formed corresponding to each row of pixel electrodes; a plurality of data lines, each of which is formed corresponding to each odd number column of pixel electrodes and the next adjacent even number column of pixel electrodes; a plurality of first switching devices, each of which is connected with each odd-number-column pixel electrode, and the data lines charging the corresponding odd-number-column pixel electrodes via the corresponding first switching devices under driving control in corresponding time sequence; a plurality of second switching devices, each of which is connected with each even-number-column pixel electrode, and the data lines charging the corresponding even-number-column pixel electrodes via the corresponding second switching devices under driving control in corresponding time sequence.

2 Claims, 8 Drawing Sheets

(56) References Cited

U.S. PATENT DOCUMENTS

| | | | | |
|---|---|---|---|---|
| 2009/0027325 | A1 | 1/2009 | Kim et al. | |
| 2010/0053042 | A1 | 3/2010 | Kajiyama et al. | |
| 2010/0157189 | A1 | 6/2010 | Ma | |
| 2011/0007062 | A1 * | 1/2011 | Chang | G09G 3/3614 345/213 |

OTHER PUBLICATIONS

USPTO NFOA dated Sep. 27, 2013 in connection with U.S. Appl. No. 13/242,061.

USPTO NOA dated Feb. 26, 2014 in connection with U.S. Appl. No. 13/242,061.

* cited by examiner

ARRAY SUBSTRATE AND DRIVING METHOD THEREOF

BACKGROUND

Embodiments of the disclosed technology relate to an array substrate and a driving method thereof.

A liquid crystal displays (LCD) has excellent characteristics such as small volume, low power consumption, non-radiation, and the like, and has been dominating the current market of the flat panel display.

The main structure of a liquid crystal display is formed by bonding an array substrate and a color filter substrate and then injecting liquid crystal material therebetween. Specifically, as shown in FIG. 1, a plurality of gate lines 11 for supplying scanning signals and a plurality of data lines 12 which are perpendicular to the gate lines and used for supplying data signals are provided on the array substrate. Pixel regions are defined by the gate lines 11 and the data lines 12, and each pixel region is provided with a thin film transistor (TFT) 13 as a switching element and a pixel electrode 14. A gate electrode 131 of the TFT 13 is connected with the corresponding gate line 11, a source electrode 132 of the TFT 13 is connected with the corresponding data line 12, and a drain electrode 133 of the TFT 13 is connected with the pixel electrode 14.

When the liquid crystal display is in operation, the gate lines are controlled by a gate driver 15 which comprises a plurality of gate driver ICs (Integrated Circuits); the data lines 12 are controlled by a source driver 16 which comprises a plurality of source driver ICs. In a line-sequence scanning mode, under the control of the gate driving signals generated by the gate driver ICs, the gate lines are turned on sequentially, and data voltages for the respective rows are transferred to the corresponding pixel electrodes 14 via the data lines 12 by the source driver ICs, so that the pixel electrodes 14 are charged to respective grey voltages for displaying corresponding grey scales and further display each frame of an image.

SUMMARY

An embodiment of the disclosed technology provides an array substrate comprising: a base substrate; an array of pixel electrodes formed on the base substrate; a plurality of gate lines, each of which is formed corresponding to each row of pixel electrodes; a plurality of data lines, each of which is formed corresponding to each odd number column of pixel electrodes and the next adjacent even number column of pixel electrodes; a plurality of first switching devices, each of which is connected with each odd-number-column pixel electrode, and the data lines charging the corresponding odd-number-column pixel electrodes via the corresponding first switching devices under driving control in corresponding time sequence; a plurality of second switching devices, each of which is connected with each even-number-column pixel electrode, and the data lines charging the corresponding even-number-column pixel electrodes via the corresponding second switching devices under driving control in corresponding time sequence.

Another embodiment of the disclosed technology provides a driving method for the above array substrate, comprising: in a first sequence period, the data lines charging the odd-number-column pixel electrodes in the first row via the corresponding first switching devices under driving control; in a second sequence period, the data lines charging the even-number-column pixel electrodes in the first row via the corresponding second switching devices under driving control; in a third sequence period, the data lines charging the odd-number-column pixel electrodes in the second row via the corresponding first switching devices under driving control; in a fourth sequence period, the data lines charging the even-number-column pixel electrodes in the second row via the corresponding second switching device under driving control; the odd number pixel electrode and the even number pixel electrodes in the remaining rows being charged in a same way and sequentially, and a charging cycle being completed when the odd-number-column pixel electrodes and the even-number-column pixel electrodes in the last row are charged.

Still another embodiment of the disclosed technology provides a driving method for the above array substrate, comprising: in a first sequence period, the data lines charging the even-number-column pixel electrodes in the first row via the corresponding second switching devices under driving control; in a second sequence period, the data lines charging the odd-number-column pixel electrodes in the first row via the corresponding first switching devices under driving control; in a third sequence period, the data lines charging the even-number-column pixel electrodes in the second row via the corresponding second switching devices under driving control; in a fourth sequence period, the data lines charging the odd-number-column pixel electrodes in the second row via the corresponding first switching devices under driving control; the odd-number-column pixel electrodes and the even-number-column pixel electrodes in the remaining rows being charged in a same way and sequentially, and a charging cycle being completed when the odd-number-column pixel electrodes and the even-number-column pixel electrodes in the last row are charged.

Further scope of applicability of the disclosed technology will become apparent from the detailed description given hereinafter. However, it should be understood that the detailed description and specific examples, while indicating preferred embodiments of the disclosed technology, are given by way of illustration only, since various changes and modifications within the spirit and scope of the disclosed technology will become apparent to those skilled in the art from the following detailed description.

BRIEF DESCRIPTION OF THE DRAWINGS

The disclosed technology will become more fully understood from the detailed description given hereinafter and the accompanying drawings which are given by way of illustration only, and thus are not limitative of the disclosed technology and wherein.

DETAILED DESCRIPTION

The disclosed technology now will be described more clearly and fully hereinafter with reference to the accompanying drawings, in which the embodiments of the disclosed technology are shown. Apparently, only some embodiments of the disclosed technology, but not all of embodiments, are set forth here, and the disclosed technology may be embodied in other forms. All of other embodiments made by those skilled in the art based on embodiments disclosed herein without mental work fall within the scope of the disclosed technology.

Figure 1:
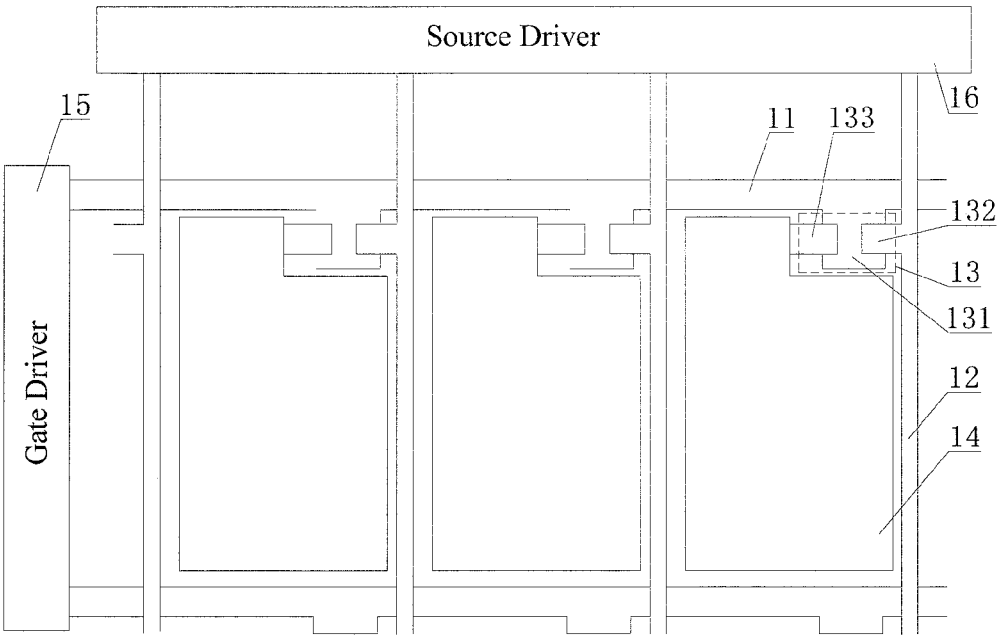
FIG. 1 is a schematic view of an array substrate in the related art.

The inventors of the disclosed technology has found that, for the array substrate as shown in FIG. 1, each pixel electrode should be controlled by a gate line and a data line simultaneously when it is charged, and the number of the source driver ICs required in the liquid crystal display is determined by the number of the data lines. That is, the more data lines are used, the more source driver ICs are required. However, the cost of the source driver ICs accounts for a larger portion of the whole cost for a liquid crystal display. Therefore, the large number of the used data lines will result in an increased cost for the liquid crystal display.

Figure 2:
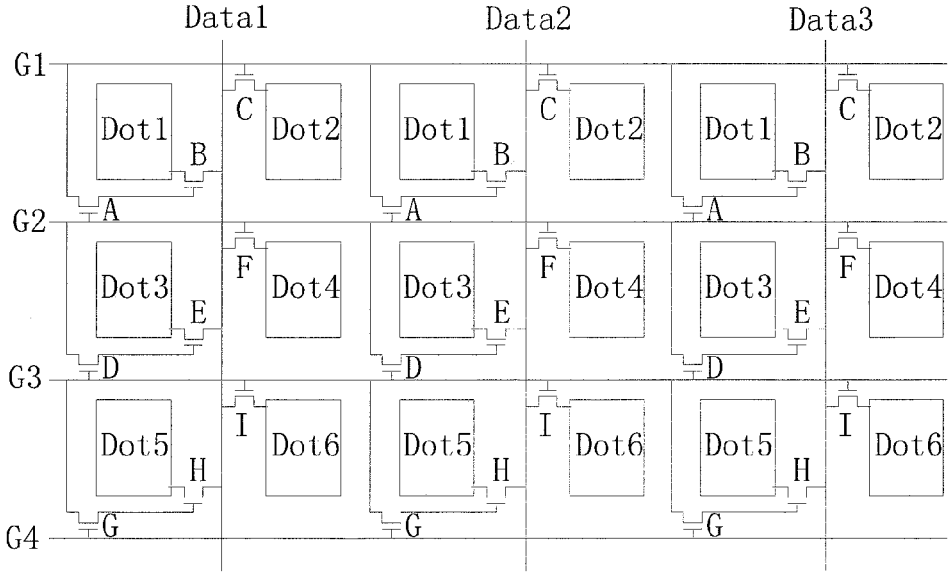
FIG. 2 is a schematic view of an array substrate according to a first embodiment of the disclosed technology.
Figure 10:
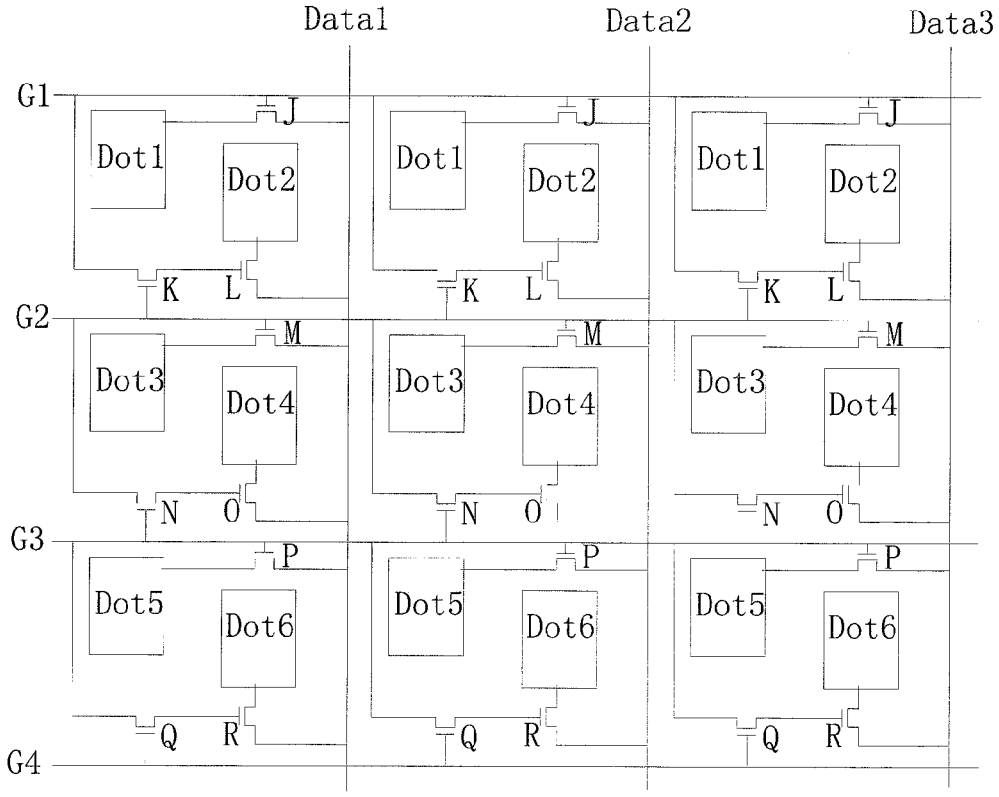
FIG. 10 is a schematic view of an array substrate according to s second embodiment of the disclosed technology.

FIG. 2 or 10 show the array substrate according to an embodiment of the disclosed technology. In the embodiment, the array substrate comprises a base substrate (omitted in each figure for clear illustration), and a pixel electrode array comprising a plurality of rows of pixel electrodes is formed on the base substrate.

For the purpose of convenient illustration, the pixel electrodes in the odd number columns among the pixel electrodes in the first row are called Dot1, and the pixel electrodes in the even number columns among the pixel electrodes in the first row are called Dot2; the pixel electrodes in the odd number columns among the pixel electrodes in the second row are called Dot3, and the pixel electrodes in the even number columns among the pixel electrodes in the second row are called Dot4; the pixel electrodes in the odd number columns among the pixel electrodes in the third row are called Dot5, and the pixel electrodes in the even number columns among the pixel electrodes in the third row are called Dot6; and the pixel electrodes in other rows are named similarly. One gate line is formed corresponding to each row of pixel electrodes. For example, one gate line G1 is formed corresponding to the pixel electrodes Dot1 and Dot2 in the first row, one gate line G2 is formed corresponding to the pixel electrodes Dot3 and Dot4 in the second row, one gate line G3 is formed corresponding to the pixel electrodes Dot5 and Dot6 in the third row, and one gate line G4 is formed corresponding to the pixel electrodes in the fourth row (not illustrated), and similarly, one gate line is formed for each row of the remaining pixel electrodes.

One data line is formed corresponding to each odd number column of pixel electrodes and the next adjacent even number column of pixel electrodes. For example, one data line Data 1 is formed corresponding to the first column of pixel electrodes and the adjacent second column of pixel electrodes; one data line Data2 is formed corresponding to the third column of pixel electrodes and the adjacent fourth column of pixel electrodes; one Data3 is formed corresponding to the fifth column of pixel electrodes and the adjacent sixth column of pixel electrodes, and similarly; and one data line is formed corresponding for each odd number column and the next adjacent even number column for the remaining pixel electrodes.

Each of pixel electrodes in each odd number column is connected with one first switching device. For example, the first switching device can be constituted of a first TFT A and a second TFT B which are connected with the pixel electrode Dot1 as shown in FIG. 2, or it can be constituted of a fourth TFT J which is connected with the pixel Dot1 as shown in FIG. 10. Under driving control in corresponding time sequence, the data lines charge the corresponding odd-number-column pixel electrodes via the corresponding first switching devices, for example, the data line Data 1 can charge the pixel electrode Dot1 in the first column and in the first row via the corresponding first switching device under driving control in corresponding time sequence, or also, the data line Data1 can charge the pixel Dot3 in the first column and in the second row via the corresponding first switching device under driving control in corresponding time sequence.

Similarly, each of pixel electrodes in each even number column is connected with one second switching device. For example, the second switching device is constituted of a third TFT C which is connected with the pixel electrode Dot2 as shown in FIG. 2, or is constituted of a fifth TFT K and a sixth TFT L which are connected with the pixel electrode Dot2 as shown in FIG. 10. Under driving control in corresponding time sequence, the data lines charge the corresponding even-number-column pixel electrodes via the corresponding second switching devices, for example, the data line Data1 can charge the pixel electrode Dot2 in the second column and in the first row via the corresponding second switching device under driving control in corresponding time sequence, or the data line Data1 can charge the pixel Dot4 in the second column and in the second row via the corresponding second switching device under driving control in corresponding time sequence.

In the array substrates according to the embodiments, only one data line is formed corresponding to each odd number column of pixel electrodes and the next adjacent even number column of pixel electrodes in the pixel electrode array on the array substrate, and the data line can charge the corresponding odd-number-column pixel electrodes and the corresponding even-number-column pixel electrodes via the first and second switching devices under the driving control in the corresponding time sequence; therefore, each odd number column of pixel electrodes and the next adjacent even number column of pixel electrodes are charged by only one data line, and the number of the data lines can be reduced in half while charging for each column of pixel electrodes can be ensured. Thus, the number of the source driver ICs in the source driving circuit board can be reduced effectively. Furthermore, the reduction in the wiring number on the source driving circuit board and the decrease of the element arrangement difficulty contribute to the decrease of the area of the circuit board, which makes the liquid crystal display thinner.

It should be noted that, as for the array substrates as mentioned above, each of the first switching devices and the second switching devices can be implemented in many ways, and the arrangement of the data lines can also be implemented in many ways. The technical solutions according to the disclosed technology will be described through some specifics embodiments hereinafter.

First Embodiment

As shown in FIG. 2, in the embodiment, each of the first switching devices comprises a first TFT (for example, the TFT A in the first row or the TFT D in the second row) and a second TFT (for example, the TFT B in the first row or the TFT E in the second row), wherein the gate electrode of the first TFT is connected with a gate line which is next adjacently to the gate line corresponding to the odd-number-column pixel electrode, the source electrode of it is connected with the gate line corresponding to the odd-number-column pixel electrode, and the drain electrode of it is connected with the gate electrode of the second TFT. For example, it can be known by taking the odd-number-column pixel electrode Dot1 in the first row as an example that, of the first TFT A, the gate electrode is connected with the gate line G2, the source electrode is connected with the Gate line G1, and the drain electrode is connected with the gate electrode of the second TFT B.

Of the second TFT, the gate electrode is connected with the drain electrode of the first TFT, the source electrode is connected with the data line corresponding to the odd-number-column pixel electrode, and the drain is connected with the corresponding odd-number-column pixel electrode. For example, as for the odd-number-column pixel electrode Dot1 in the first row, the gate electrode of the second TFT B is connected with the drain electrode of the first TFT A, the source electrode is connected with the data line Data1, the drain electrode is connected with the odd-number-column pixel electrode Dot1.

Similarly, as for the odd-number-column pixel electrode Dot3 in the second row, the first switching device comprises a first TFT D and a second TFT E, wherein the first TFT D is connected in a similar manner as the first TFT A, and the second TFT E is connected in similar manner as the second TFT B. The first switching device for the odd-number-column pixel electrode Dot5 in the third row comprises a first TFT G and a second TFT H. Similarly, the first switching devices for the odd-number-column pixel electrodes in the other rows are similar to the first switching devices as mentioned above.

Each of the second switching device used in the embodiment comprises a third TFT (for example, the TFT C in the first row or the TFT F in the second row), wherein the gate electrode of it is connected with the gate line corresponding to the even-number-column pixel electrode, the source electrode of it is connected with the data line corresponding to the even-number-column pixel electrode, and the drain electrode of it is connected with the corresponding even-column-number pixel electrode. For example, as for the even-number-column Dot2 in the first row, the gate electrode of the third TFT C is connected with the gate line G1, the source electrode is connected with the data line Data 1, and the drain electrode is connected with the even-number-column pixel electrode Dot2.

Similarly, as for the even-number-column pixel electrode Dot4 in the second row, the second switching device comprises a third TFT F, wherein the third TFT F is connected in a similar manner as the third TFT C. The second switching device for the even-number-column pixel electrode Dot6 in the third row comprises a third TFT I. Similarly, the second switching devices for the even-number-column pixel electrodes in the other rows are similar to the second switching devices as mentioned above.

In addition, it can be seen from FIG. 2 that each of the data lines in the embodiment may be arranged between the corresponding odd number column of pixel electrodes and the next adjacent even number column of pixel electrodes. For example, the Data line Data1 is arranged between the corresponding first column of pixel electrodes and the second column of pixel electrodes, and the data line Data2 is arranged between the corresponding third column of pixel electrodes and the fourth column of pixel electrodes, and the data line Data3 is arranged between the corresponding fifth column of the pixel electrodes and the sixth column of pixel electrodes.

Figure 12:
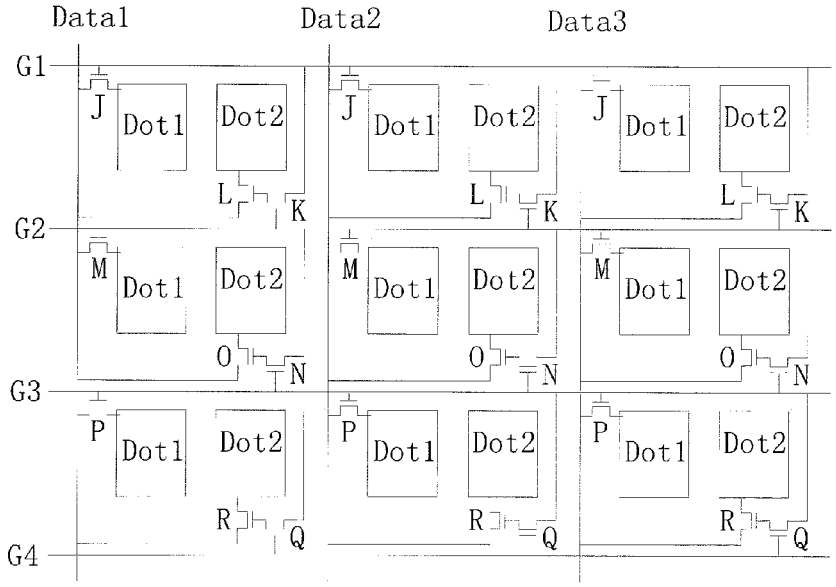
FIG. 12 is a schematic view of an array substrate according to another example of the second embodiment of the invention.

Furthermore, each of the data lines in the embodiment can also be arranged at the right side of the corresponding odd number column of pixel electrodes and the next adjacent even number column of pixel electrodes (like the arrangement shown in FIG. 10). Alternatively, each of the data lines can be arranged at the left side of the corresponding odd number column and the next adjacent even number column (like the arrangement shown in FIG. 12).

Specifically, the arrangement positions of the data lines may be selected according to the actual patterns on the array substrate and the patterning processes.

Figure 3:
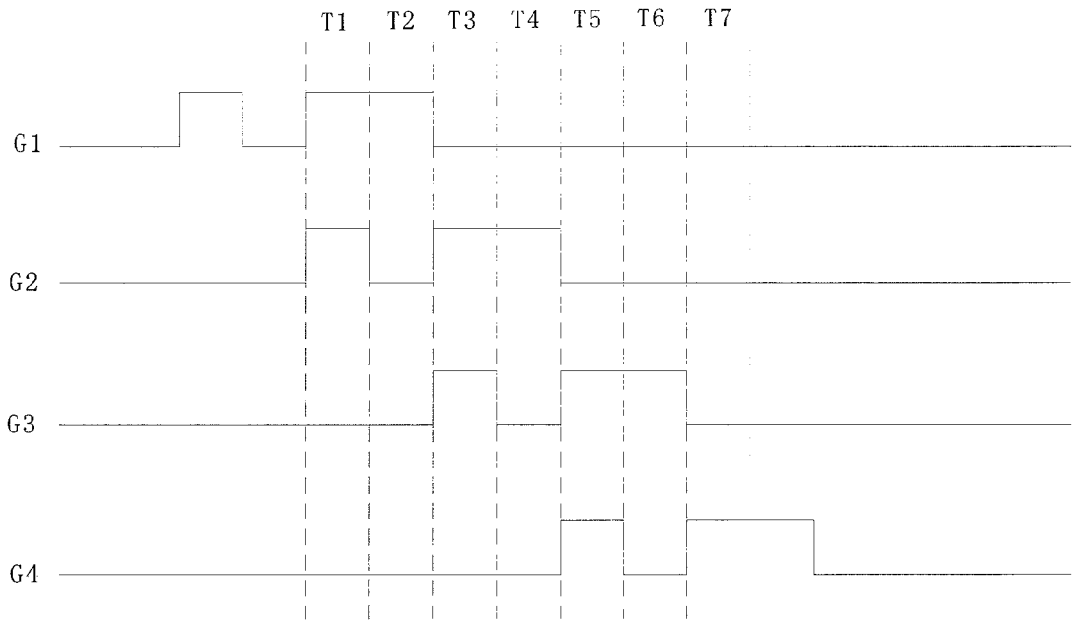
FIG. 3 is a driving sequence chart for the array substrate shown in FIG. 2.

FIG. 3 shows a driving sequence chart according to the embodiment, wherein G1 represents the gate line in the first row, G2 represents the gate line in the second row, G3 represents the gate line in the third row, G4 represents the gate line in the fourth row, and so on. T1 represents the first sequence period, T2 represents the second sequence period, T3 represents the third sequence period, T4 represents the fourth sequence period, T5 represents the fifth sequence period, T6 represents the sixth sequence period, T7 represents the seventh sequence period and so on.

The driving method for the array substrate will be explained hereinafter by referring to the array substrate embodiment shown in FIG. 2 and the driving sequence chart as shown in FIG. 3. Specifically, the following description is only about a part of the array substrate, but the driving process as described can be adapted to the whole array substrate. In the following description, "1" represents a high level (rendering the corresponding TFT be turned on), "0" represents a low level (rendering the corresponding TFT be turned off). The specific driving process is described as follows.

Figure 4:
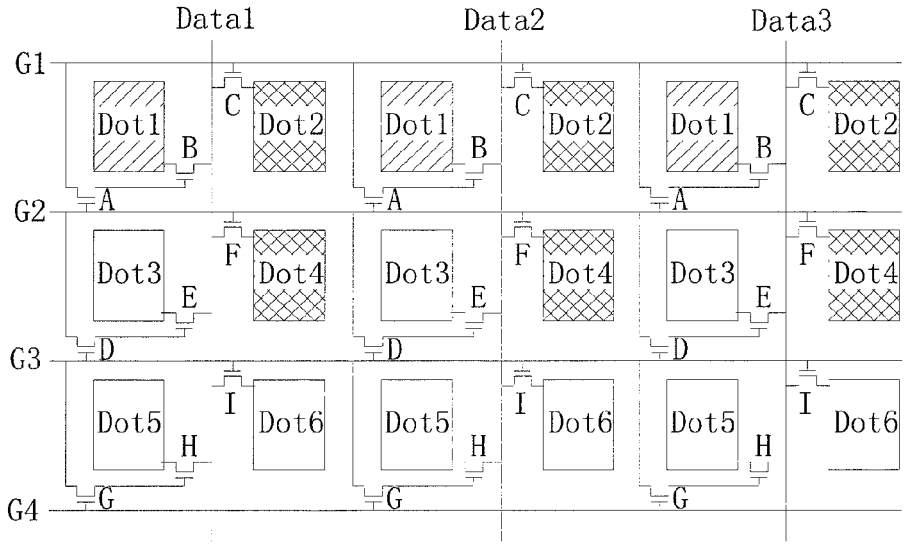
FIG. 4 is a schematic view showing a state after driving within the first sequence period for the array substrate shown in FIG. 2.

In the T1 stage, the gate drivers connected with gate lines render G1=1, G2=1, G3=0, and G4=0. When G2 is at the high level, the first TFTs A in the first row are turned on; also because G1 is at the high level, the second TFTs B in the first row are turned on. Then, as shown in FIG. 4, the data lines Data1, Data2, and Data3 charge the odd-number-column pixel electrodes Dot1 in the first row to required grey voltages. The charged odd-number-column pixel electrodes Dot1 at the T1 stage are shown with a sparse hatched pattern slanting upward to right in FIG. 4.

At this time, because G1 is at the high level, the third TFTs C in the first row are turned on, and the data lines Data1, Data2, Data3 . . . charge the even-number-column pixel electrodes Dot2 to the grey voltages required by the pixel electrodes Dot1 (shown in grid in FIG. 4). In most cases, the grey voltages required by the pixel electrodes Dot2 are different from those required by the pixel electrodes Dot1; therefore, charging the pixel electrodes Dot2 at this time may lead to an error display. However, the pixel electrodes Dot2 will be charged only in the T2 period. For example, for a liquid crystal display with 768 gate lines to be controlled even within 1 second, the pixel electrodes Dot2 of the liquid crystal display are remained in the error display state only for 1/768 second, and can be kept in a state of correct display for the remaining 767/768 second. It can be known by the above comparison that the time for error display will be extremely short and will not be identified by a person's eyes, and the normal viewing on the liquid crystal display will not be influenced. In addition, if the grey voltages required by the pixel electrodes Dot2 are accidently equal to those required by the pixel electrodes Dot1, then the charged voltages on the pixel electrodes Dot2 are just equal to the voltages required by the pixel electrodes Dot2 in the T1 stage; therefore, actually no error display will be caused on the liquid crystal display.

Similarly, at this time, because G2 is at the high level, the third TFTs F in the second row are turned on. The data lines Data 1, Data2, Data 3 . . . charge the even-number-column pixel electrodes Dot4 to the grey voltages required by the pixel electrodes Dot1 (shown in grid in FIG. 4). In most cases, the grey voltages required by the pixel electrodes Dot4 are different from those required by the pixel electrodes Dot1; therefore, charging the pixel electrodes Dot4 at this time may lead to an error display. However, the pixel electrodes Dot4 will be charged only in the T4 period. In this case, for example, for a liquid crystal display with 768 gate lines to be controlled within 1 second, the pixel electrodes Dot4 of the liquid crystal display are remained in the error display only for 3/768 second, and can be kept in a state of correct display for the remaining 765/768 second. It can be known by the above comparison that the time for error display will be extremely short and will not be identified by a person's eyes, and the normal viewing on the liquid crystal display will not be influenced. In addition, if the grey voltages required by the pixel electrodes Dot4 are accidently equal to those required by the pixel electrodes Dot1, then the charged voltages on the pixel electrodes Dot4 are just equal to the voltages required by the pixel electrodes Dot1 in the T1 stage; therefore, actually no error display will be caused on the liquid crystal display.

Figure 5:
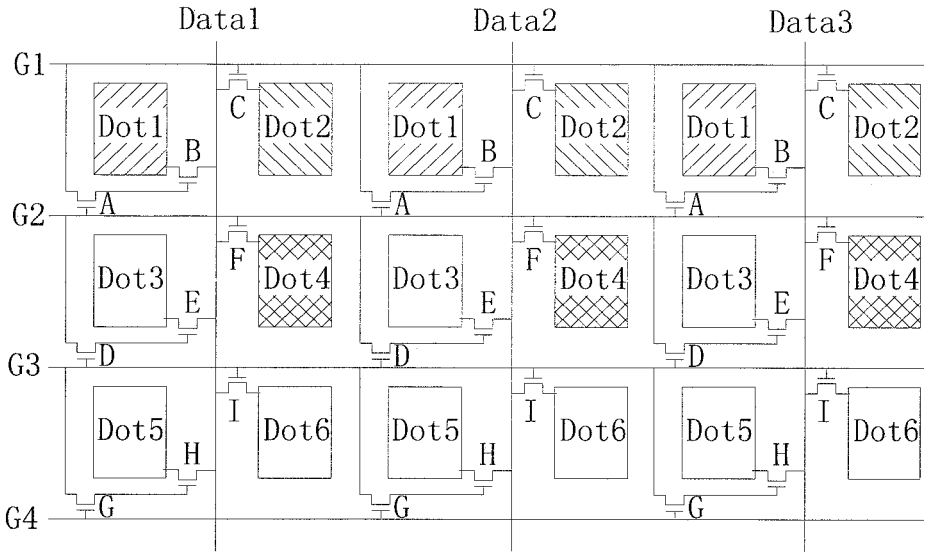
FIG. 5 is a schematic view showing a state after driving within the second sequence period for the array substrate shown in FIG. 2.

In the T2 stage, the gate drivers connected with gate lines render G1=1, G2=0, G3=0, and G4=0. When G1 is at the high level, the third TFT C in the first row is turned on, as shown in FIG. 5, the data lines Data1, Data2, Data3 . . . charge the even-number-column pixel electrodes Dot2 in the first row to required grey voltages. The charged even-number-column pixel electrodes Dot2 at the T2 stage are shown with a sparse hatched pattern slanting downward to right in FIG. 5. At this time, because G2 is at the low level, the first TFTs A and the second TFTs B in the first row are turned off, and the voltages on the pixel electrodes Dot1 is kept. When G2 is at the low level, the third TFTs F in the second row are also turned off, and the voltages on the pixel electrodes Dot4 is kept.

Figure 6:
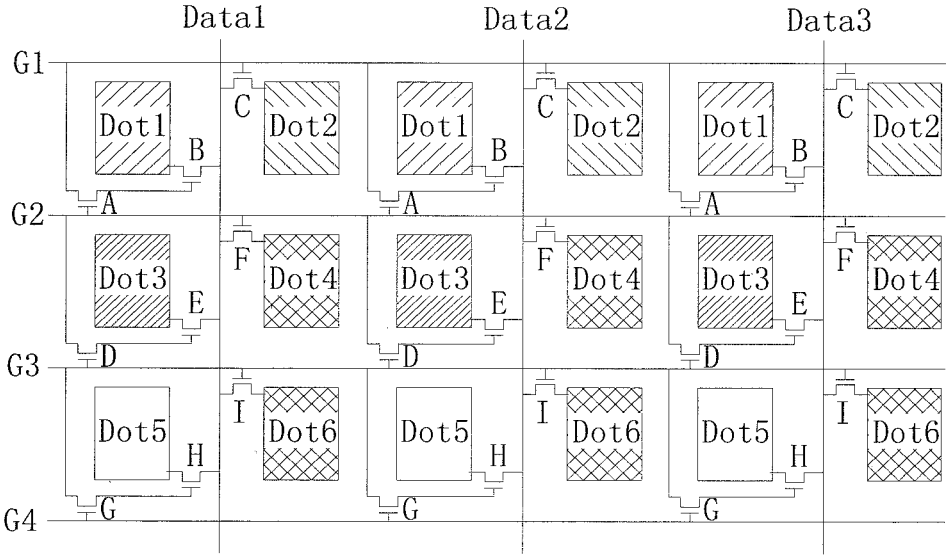
FIG. 6 is a schematic view showing a state after driving within the third sequence period for the array substrate shown in FIG. 2.

In the T3 stage, the gate drivers connected with gate lines render G1=0, G2=1, G3=1, and G4=0. When G3 is at the high level, the first TFTs D in the second row are turned on; also because G2 is at the high level, the second TFTs E in the second row are thus turned on. Then, as shown in FIG. 6, the data lines Data1, Data2, Data3 . . . charge the odd-number-column pixel electrodes Dot3 in the second row to required grey voltages. The charged odd-number-column pixel electrodes Dot3 at the T3 stage are shown with a dense hatched pattern slanting upward to right in FIG. 6.

Similarly to the T1 stage, at this time, because G2 is at the high level, the third TFTs F in the second row are turned on, and the data lines Data1, Data2, Data3 . . . charge the even-number-column pixel electrodes Dot4 (shown in grid in FIG. 6). When the grey voltages required by the pixel electrodes Dot4 are different from those required by the pixel electrodes Dot3, charging the pixel electrodes Dot4 at this time may lead to an error display. However, the time for error display will be extremely short. In addition, if the grey voltages required by the pixel electrodes Dot4 are accidently equal to those required by the pixel electrodes Dot3, then charging the pixel electrode Dot4 at this time will not lead to the error display. Similarly, because G3 is at the high level, the third TFTs I in the third row are turned on, and the data lines Data1, Data2, Data3 . . . charge the even-number-column pixel electrodes Dot6 (shown in grid in FIG. 6). When the grey voltages required by the pixel electrodes Dot6 are different from those required by the pixel electrodes Dot3, charging the pixel electrodes Dot6 at this time may lead to an error display. However, the time for error display will be extremely short. In addition, if the grey voltages required by the pixel electrodes Dot6 are accidently equal to those required by the pixel electrodes Dot3, then charging the pixel electrodes Dot6 at this time will not lead to the error display.

At this time, because G1 is at the low level and G2 is at the high level, the first TFTs A in the first row are turned on, the second TFTs B in the first row are turned off, the voltages on the pixel electrodes Dot1 are continuously be kept. Because G1 is at the low level, the third TFTs C in the first row are turned off, and the voltages on the pixel electrodes Dot2 are kept.

Figure 7:
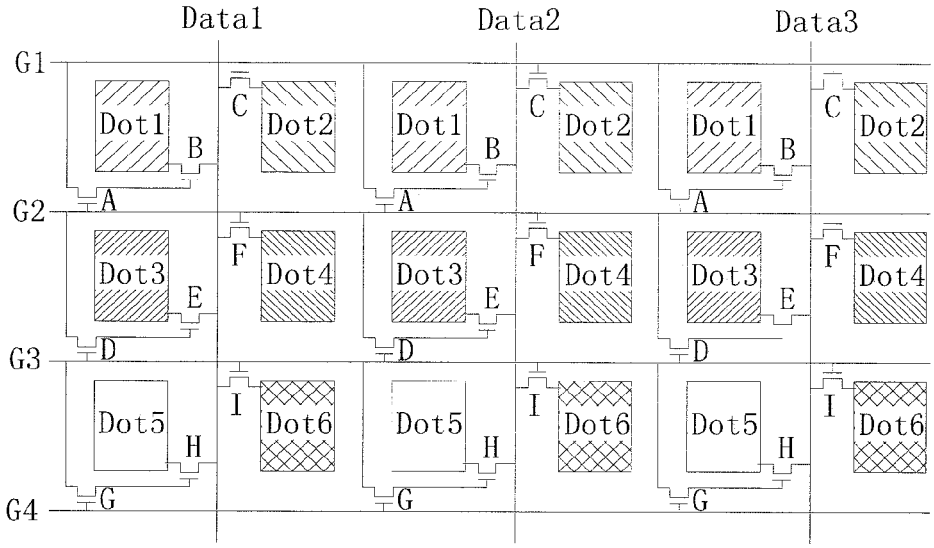
FIG. 7 is a schematic view showing a state after driving within the fourth sequence period for the array substrate shown in FIG. 2.

In the T4 stage, the gate drivers connected with gate lines render G1=0, G2=1, G3=0, and G4=0. When G2 is at the high level, the third TFTs F in the second row are turned on, as shown in FIG. 7, the data lines Data1, Data2, Data3 . . . charge the even-number-column pixel electrodes Dot4 in the second row to required grey voltages. The charged even-number-column pixel electrodes Dot4 at the T4 stage are shown with a dense hatched pattern slanting downward to right in FIG. 7. At this time, because G1 is at the low level and G2 is at the high level, the first TFTs A in the first row are turned on and the second TFTs B in the first row are turned off, the voltages on the pixel electrodes Dot1 are kept. When G1 is at the low level, the third TFTs C in the first row are also turned off, and the voltages on the pixel electrodes Dot2 are kept. In addition, because G3 is at the low level, the first TFTs D and the second TFTs E in the second row are turned off, and the voltages on the pixel electrodes Dot3 are kept.

Figure 8:
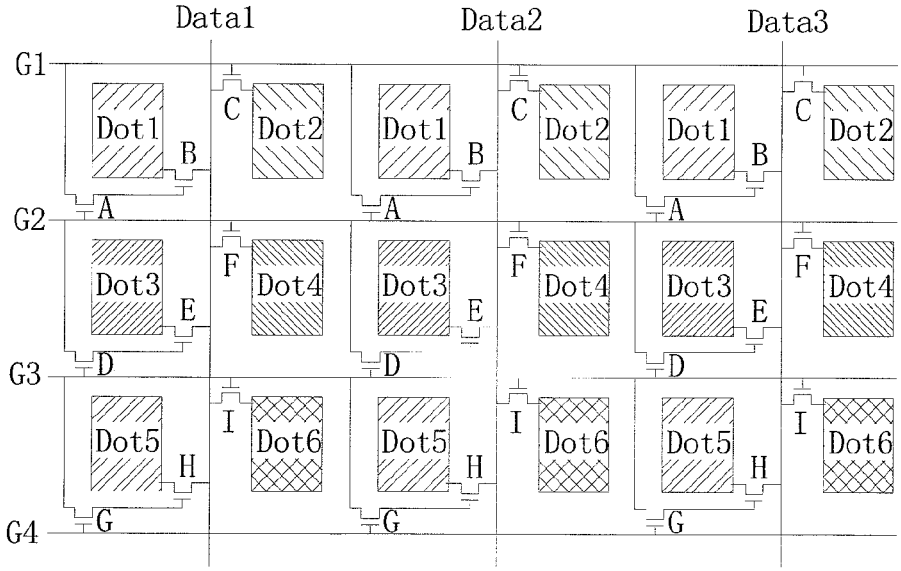
FIG. 8 is a schematic view showing a state after driving within the fifth sequence period for the array substrate shown in FIG. 2.

In the T5 stage, the gate drivers connected with gate lines render G1=0, G2=0, G3=1, and G4=1. When G4 is at the high level, the first TFTs G in the third row are turned on. Because G3 is at the high level, the second TFTs H in the third row are turned on. Then, as shown in FIG. 8, the data lines Data1, Data2, Data3 . . . charge the pixel electrodes Dot5 in the third row to required grey voltages. The charged odd-number-column pixel electrodes Dot5 at the T5 stage are shown with a double-line hatched pattern slanting upward to right in FIG. 8.

Similarly to the T1 and T3 stages, at this time, because G3 is at the high level, the third TFTs I in the third row are turned on, and the data lines Data1, Data2, Data3 . . . charge the even-number-column pixel electrodes Dot6 (shown in grid in FIG. 8). When the grey voltages required by the pixel electrodes Dot6 are different from those required by the pixel electrodes Dot5, charging the pixel electrodes Dot6 at this time may lead to an error display. However, the time for error display will be extremely short. In addition, if the grey voltages required by the pixel electrodes Dot6 are accidently equal to those required by the pixel electrodes Dot5, then charging the pixel electrodes Dot6 at this time will not lead to the error display. Similarly, because G4 is at the high levels, the third TFTs in the fourth row are turned on, and the data lines Data1, Data2, Data3 . . . charge the even-number-column pixel electrodes in the fourth row (shown in grid in FIG. 8). When the grey voltages required by the even-number-column pixel electrodes in the fourth row are different from those required by the pixel electrodes Dot5, charging the even-number-column pixel electrodes in the fourth row at this time may lead to an error display. However, the time for the error display will be extremely short. In addition, if the grey voltages required by the even-number-column pixel electrodes in the fourth row are accidently equal to those required by the pixel electrodes Dot5, then charging the even-number-column pixel electrode at this time will not lead to the error display.

In addition, at this time, because both G1 and G2 are at the low level, the first TFTs A and the second TFTs B in the first row are turned off, and the voltages on the pixel electrodes Dot1 are kept. When G1 is at the low level, the third TFTs C in the first row are turned off, the voltages on the pixel electrodes Dot2 are kept. When G2 is at the low level and G3 is at the high level, the first TFTs D in the second row are turned on, the second TFTs E are turned off, and the voltages on the pixel electrodes Dot3 are kept. When G2 is at the low level, the third TFTs F in the second row are turned off, and the voltages on the pixel electrodes Dot4 are kept.

Figure 9:
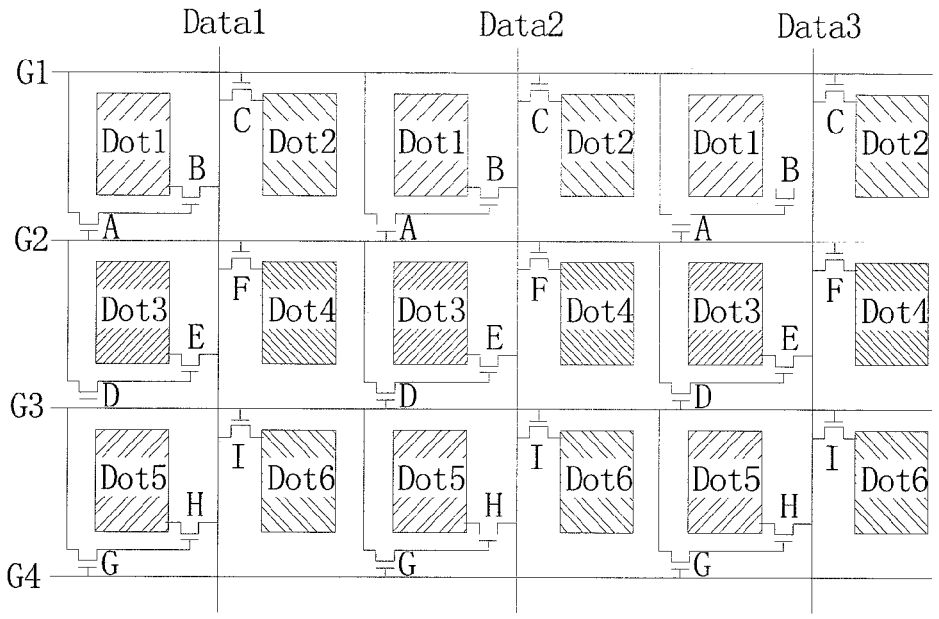
FIG. 9 is a schematic view showing a state after driving within the sixth sequence period for the array substrate shown in FIG. 2.

In the T6 stage, the gate drivers connected with gate lines render G1=0, G2=0, G3=1, and G4=0. When G3 is at the high level, the third TFTs I in the third row are turned on, as shown in FIG. 9, and the data lines Data1, Data2, Data3 . . . charge the even-number-column pixel electrodes Dot6 in the third row to required grey voltages. The charged even-number-column pixel electrodes Dot6 at the T6 stage are shown with a double-line hatched pattern slanting downward to right in FIG. 9. At this time, because both G1 and G2 are at the low level, the first TFTs A and the second TFTs B in the first row are turned off, and the voltages on the pixel electrodes Dot1 are kept. When G1 is at the low level, the third TFTs C in the first row are also turned off, and the voltages on the pixel electrodes Dot2 are kept. When G2 is at the low level and G3 is at the high level, the first TFTs D in the second row are turned on, and the second TFTs E are turned off, and the voltages on the pixel electrodes Dot3 are kept. When G2 is at the low level, the third TFTs F in the second row are turned off, and the voltages on the pixel electrodes Dot4 are kept. When G4 is at the low level, the first TFTs G and the second TFTs H in the third row are turned off, and the voltages on the pixel electrodes Dot5 are kept.

Thereafter, charging the odd-number-column pixel electrodes and the even-number-column pixel electrodes in the remaining rows are similar to those mentioned above. When all the pixel electrodes are charged in a cycle, the next cycle can be performed according to the above sequence.

It can be known from the above that, in the embodiment, only one data line is used for charging each odd number column of pixel electrodes and the next adjacent even number column of pixel electrodes; therefore, the number of the data lines used on the array substrate is reduced in half, and the number of the used source driver ICs is reduced and the cost of the liquid crystal display is reduced.

Second Embodiment

As shown in FIG. 10, each of the first switching devices used in the embodiment comprises a fourth TFT (e.g., the TFT J in the first row or the TFT M in the second row). The gate electrode of the fourth TFT is connected with the gate line corresponding to the odd-number-column pixel electrode, the source electrode is connected with the data line corresponding to the odd-number-column pixel electrode, and the drain electrode is connected with the corresponding odd-number-column pixel electrode. For example, as for the odd-number-column pixel electrodes Dot1 in the first row, the gate electrode of the fourth TFT J is connected with the gate line G1, the source electrode is connected with the data line Data1, and the drain electrode is connected with the corresponding odd-number-column pixel electrode Dot1.

Similarly, as for the odd-number-column pixel electrodes Dot3 in the second row, each of the first switching devices comprises a fourth TFT M, wherein the fourth TFT M is connected in a similar manner as the fourth TFT J. The odd-number-column pixel electrodes Dot 5 in the third row use the first switching devices each of which comprise a fourth TFT P. Similarly, the first switching devices used for the odd-number-column pixel electrodes in the remaining rows are the same as the first switching devices as mentioned above.

In this embodiment, each of the second switching devices used herein comprises a fifth TFT (for example, the TFT K in the first row or the TFT N in the second row) and a sixth TFT (for example, the TFT L in the first row or the TFT O in the second row). Of the fifth TFT, the gate electrode is connected with a gate line next to the gate line corresponding to the even-number-column pixel electrode, the source electrode is connected with the data line corresponding to the even-number-column pixel electrode, and the drain electrode is connected with the gate electrode of the sixth TFT. For example, as for the even-number-column pixel electrodes Dot2 in the first row, the gate electrode of the fifth TFT K is connected with the gate line G2, the source electrode is connected with the gate line G1, the drain electrode is connected with the gate electrode of the sixth TFT L. The gate electrode of the sixth TFT is connected with the drain electrode of the fifth TFT, the source electrode is connected with the data line corresponding to the even-number-column pixel electrode, and the drain electrode is connected with the even-number-column pixel electrode. For example, as for the even-number-column pixel electrodes Dot2 in the first row, the gate electrode of the sixth TFT L is connected with the drain electrode of the fifth TFT K, the source electrode is connected with the data line Data1, the drain electrode is connected with the corresponding even-number-column pixel electrode Dot2.

Similarly, as for the even-number-column pixel electrodes Dot4 in the second row, each of the second switching devices comprises the fifth TFT N and the sixth TFT O, wherein the fifth TFT N is connected in a similar manner as the fifth TFT K, and the sixth TFT O is connected in a similar manner as the sixth TFT L. Each of the second switching devices used for the even-number-column pixel electrodes Dot6 in the third row comprises the fifth TFT Q and the sixth TFT R. Similarly, the second switching devices used for the even-number-column pixel electrodes in the remaining rows are the same as those of the second switching devices as mentioned above.

It can be known from FIG. 10 that, in the embodiment, each of the data line is arranged at the right side of the corresponding odd number column of pixel electrodes and the next adjacent even number column of pixel electrodes. For example, the data line Data1 is arranged at the right side of the corresponding second column of pixel electrodes, and the data line Data2 is arranged at the right side of the corresponding fourth column of pixel electrodes, and the data line Data3 is arranged at the right side of the corresponding sixth column of pixel electrodes.

Alternatively, in this embodiment, each of the data lines may also be arranged at the left side of the corresponding odd number column of pixel electrodes and the next adjacent even number column of pixel electrode. For example, the data line Data1 is arranged at the left side of the corresponding first column of pixel electrodes, and the data line Data2 is arranged at the left side of the corresponding third column of pixel electrodes, and the data line Data3 is arranged at the left side of the corresponding fifth column of pixel electrodes.

Alternatively, each of the data lines in the embodiment may also be arranged between the corresponding odd number column of pixel electrodes and the next adjacent even number column of pixel electrodes (the arrangement manner is the same as that shown in FIG. 2).

Figure 11:
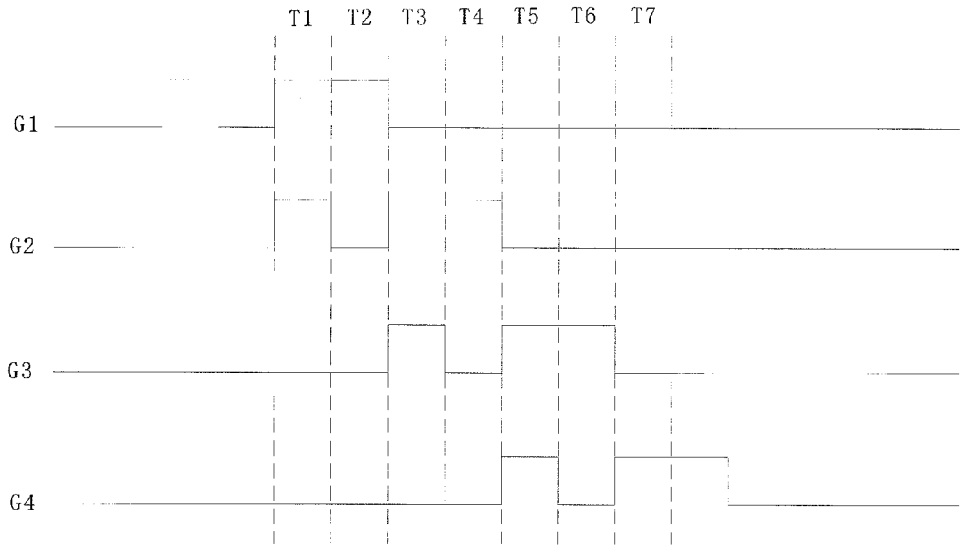
FIG. 11 is a driving sequence chart for the array substrate shown in FIG. 10.

FIG. 11 shows a driving sequence chart according to the embodiment, wherein G1 represents the gate line in the first row, G2 represents the gate line in the second row, G3 represents the gate line in the third row, G4 represents the gate line in the fourth row, and the like. T1 represents the first sequence period, T2 represents the second sequence period, T3 represents the third sequence period, T4 represents the fourth sequence period, T5 represents the fifth sequence period, T6 represents the sixth sequence period, T7 represents the seventh sequence period, and the like.

The driving method for the array substrate will be explained hereinafter by referring to the array substrate embodiment shown in FIG. 10 and the driving sequence chart as shown in FIG. 11. Specifically, the following description is only about a part of the array substrate, but the driving process as described can be suitable for the whole array substrate. In the following description, "1" represents a high level (making the corresponding TFT be turned on), "0" represents a low level (making the corresponding TFT be turned off). The specific driving process is described as follows.

Figure 13:
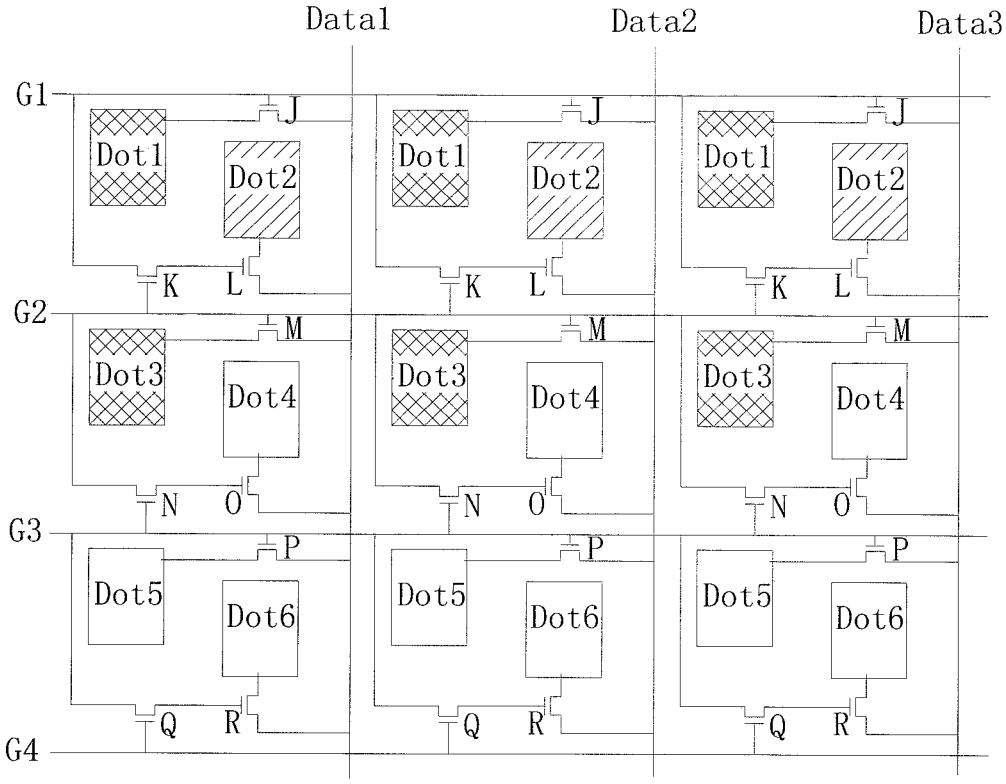
FIG. 13 is a schematic view showing a state after driving within the first sequence period for the array substrate shown in FIG. 10.

In the T1 stage, the gate driver connected with each gate line render G1=1, G2=1, G3=0, and G4=0. When G2 is at the high level, the fifth TFTs K in the first row are turned on; because G1 is at the high level, the sixth TFT L in the first row are turned on. Then, as shown in FIG. 13, the data lines Data1, Data2, Data3 . . . charge the even-number-column pixel electrodes Dot2 in the first row to required grey voltages. The charged even-number-column pixel electrodes Dot2 at the T1 stage are shown with a sparse hatched pattern slanting upward to right in FIG. 13.

At this time, because G1 is at the high level, the fourth TFTs J in the first row are turned on, and the data lines Data1, Data2, Data3 . . . charge the odd-number-column pixel electrodes Dot1 to the grey voltages which are required by the pixel electrodes Dot2 (shown in grid in FIG. 13). In most cases, the grey voltages required by the pixel electrodes Dot1 are different from those required by the pixel electrodes Dot2; therefore, charging the pixel electrodes Dot1 at this time may lead to an error display. However, the pixel electrodes Dot1 will be charged only in the T2 stage. In this case, for example, for a liquid crystal display with 768 gate lines to be controlled within 1 second, the pixel electrodes Dot1 of the liquid crystal display are remained in the error display only for $1/768$ second, and can be kept in a state of correct display for the remaining $767/768$ second. It can be known by the above comparison that the time for the error display will be extremely short and will not be identified by a person's eyes, and the normal viewing on the liquid crystal display will not be influenced. In addition, if the grey voltages required by the pixel electrodes Dot1 are accidently equal to those required by the pixel electrodes Dot2, then the charged voltages on the pixel electrodes Dot1 are just equal to the voltages required by the pixel electrodes Dot2 in the T1 stage; therefore, actually no error display will be caused on the liquid crystal display.

Similarly, at this time, because G2 is at the high level, the fourth TFTs M in the second row are turned on. The data lines Data 1, Data2, Data 3 . . . charge the odd-number-column pixel electrodes Dot3 to the grey voltages required by the pixel electrodes Dot2 (shown in grid in FIG. 13). In most cases, the grey voltages required by the pixel electrodes Dot3 are different from those required by the pixel electrodes Dot2; therefore, charging the pixel electrode Dot3 at this time may lead to an error display. However, the pixel electrodes Dot3 will be charged only in the T4 stage. In this case, for example, for a liquid crystal display with 768 gate lines to be controlled within 1 second, the pixel electrodes Dot3 of the liquid crystal display are remained in the error display only for $3/768$ second, and can be kept in a state of correct display for $765/768$ second. It can be known by the above comparison that the time for error display will be extremely short and will not be identified by a person's eyes, and the normal viewing on the liquid crystal display will not be influenced. In addition, if the grey voltages required by the pixel electrodes Dot3 are accidently equal to those required by the pixel electrodes Dot2, then the charged voltages on the pixel electrodes Dot3 are just equal to the voltages required by the pixel electrodes Dot3 in the T1 stage; therefore, actual no error display will be caused on the liquid crystal display.

Figure 14:
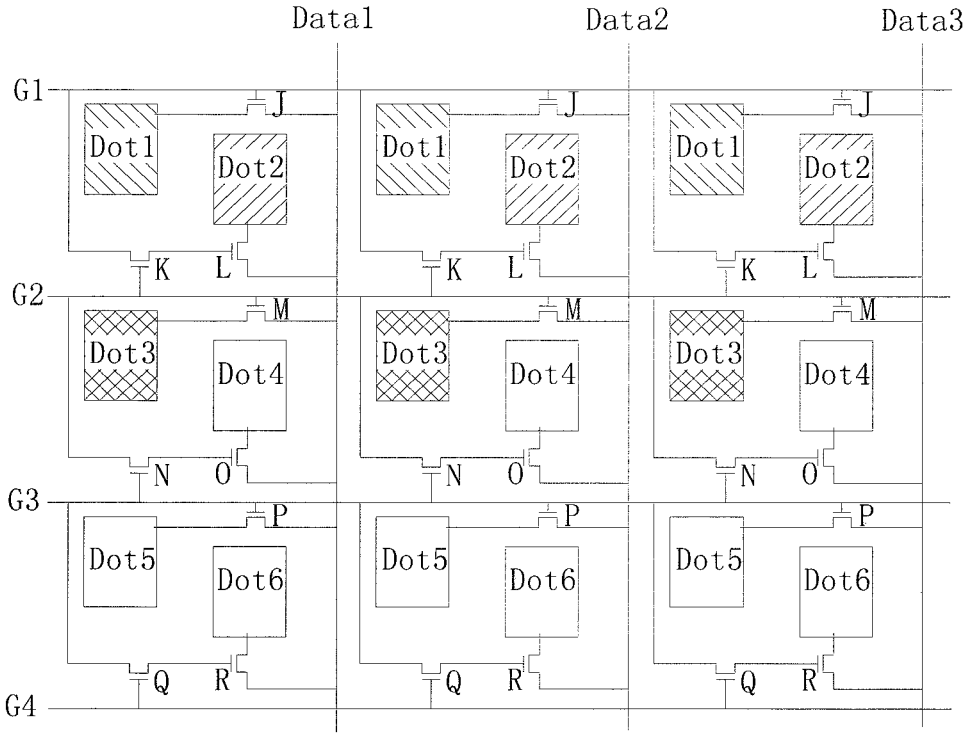
FIG. 14 is a schematic view showing a state after driving within the second sequence period for the array substrate shown in FIG. 10.

In the T2 stage, the gate drivers connected with gate lines render G1=1, G2=0, G3=0, and G4=0. When G1 is at the high level, the fourth TFTs J in the first row are turned on, as shown in FIG. 14, the data lines Data1, Data2, Data3 . . . charge the odd-number-column pixel electrodes Dot1 in the first row to required grey voltages. The charged even-number-column pixel electrodes Dot1 at the T2 stage are shown with a sparse hatched pattern slanting downward to right in FIG. 14. At this time, because G2 is at the low level, the fifth TFTs K and the sixth TFTs L in the first row are turned off, and the voltages on the pixel electrodes Dot2 are kept.

It can be known from the above charging process that, in the T3 stage, the data lines Data1, Data2, Data3 . . . charges the even-number-column pixel electrodes Dot4 in the second row; in the T4 stage, the data lines Data1, Data2, Data3 . . . charges the odd-number-column pixel electrodes Dot3 in the second row; in the T5 stage, the data lines Data1, Data2, Data3 . . . charges the even-number-column pixel electrodes Dot6 in the third row; and in the T6 stage, the data lines Data1, Data2, Data3 . . . charges the odd-number-column pixel electrodes Dot5 in the third row. As for the odd-number-column and even-number-column pixel electrodes in the remaining rows which are not illustrated in FIG. 10, they can be charged similarly as mentioned above. When all the pixel electrodes are charged in a cycle, the next cycle can be performed according to the above sequence.

It can be seen from the above that the embodiment is similar to the first embodiment with a difference in that: the odd-number-column pixel electrodes are charged firstly and then the even-number-column pixel electrodes are charged in the first embodiment, but the even-number-column pixel electrodes are charged firstly and then the odd-number-column pixel electrodes are charged in the present embodiment. In the embodiment, only one data line is used for charging each odd number column of pixel electrodes and the next adjacent even number column of pixel electrodes; therefore, the number of the data lines used on the array substrate is reduced in half, and the number of the used source driver ICs is reduced and the cost of the liquid crystal display is reduced.

Furthermore, the embodiment of the disclosed technology also provides a driving method for driving the above mentioned array substrates. The driving method comprises the following steps.

S1501, in a first sequence period, the data lines charge the odd-number-column pixel electrodes in the first row via the corresponding first switching devices under driving control;

S1502, in a second sequence period, the data lines charge the even-number-column pixel electrodes in the first row via the corresponding second switching devices under driving control;

S1503, in a third sequence period, the data lines charge the odd-number-column pixel electrodes in the second row via the corresponding first switching devices under driving control; and S1504, in a fourth sequence period, the data lines charge the even-number-column pixel electrodes in the second row via the corresponding second switching device under driving control.

Then, the odd-number-column pixel electrodes and the even-number-column pixel electrodes in the remaining rows are charged similarly and sequentially, and the cycle is completed when the odd-number-column pixel electrodes and the even-number-column pixel electrodes in the last row are charged.

Wherein the first switching devices in the driving method are the same as the first switching devices in the first embodiment, and the second switching devices in the driving method are the same as the second switching devices in the first embodiment.

The embodiment of the disclosed technology also provides another driving method for the above array substrates. The driving method comprises the following steps.

S1601, in a first sequence period, the data lines charge the even-number-column pixel electrodes in the first row via the corresponding second switching devices under driving control;

S1602, in a second sequence period, the data lines charge the odd-number-column pixel electrodes in the first row via the corresponding first switching devices under driving control;

S1603, in a third sequence period, the data lines charge the even-number-column pixel electrodes in the second row via the corresponding second switching devices under driving control; and S1604, in a fourth sequence period, the data lines charge the odd-number-column pixel electrodes in the second row via the corresponding first switching devices under driving control.

Then, the odd-number-column pixel electrodes and the even-number-column pixel electrodes in the remaining rows are charged similarly and sequentially, and the cycle is completed when the odd-number-column pixel electrodes and the even-number-column pixel electrodes in the last row are charged.

The first switching devices in the driving method are the same as the first switching devices in the second embodiment, and the second switching devices in the driving method are the same as the second switching devices in the second embodiment.

The above two driving methods are similar to each other with a difference in that: the odd-number-column pixel electrodes are charge firstly and then the even-number-column pixel electrodes are charged in the first driving method; however, the even-number-column pixel electrodes are charge firstly and then the odd-number-column pixel electrodes are charged in the second driving method. Because the same data line can be used to charge an odd number column pixel electrode (or even number column pixel electrode) first and then charge an even number column pixel electrode (or odd number column pixel electrode) in the two driving methods, only one data line is used for each odd number column of pixel electrodes and the next adjacent number column of pixel electrodes, and the one data line is used in time-sharing multiplexing manner. Therefore, the number of the used data lines is reduced and further the number of the used source driver ICs is reduced, which reduces the cost of the liquid crystal display.

It can be understood by those skilled in the art that the entire or a part of the method according to the above embodiments can be performed through hardware, software, firmware of a program. The program can be stored in a computer readable storage medium. When the above program is conducted, the steps in the above method embodiments can be performed. The above storage medium comprises various media which can storage program code, such as ROM, RAM, magnetic disk or optical disk.

It should be noted that: the above embodiments only have a purpose of illustrating the disclosed technology, but not limiting it. Although the disclosed technology has been described with reference to the above embodiment, those skilled in the art should understand that modifications or alternations can be made to the solution or the technical feature in the described embodiments without departing from the spirit and scope of the disclosed technology.

What is claimed is:

1. A driving method for an array substrate, the array substrate comprising a base substrate; an array of pixel electrodes formed on the base substrate; a plurality of gate lines, each of which is formed corresponding to each row of pixel electrodes; a plurality of data lines, each of which is formed corresponding to each odd number column of pixel electrodes and the next adjacent even number column of pixel electrodes; a plurality of first switching devices, each of which is connected with each odd-number-column pixel electrode, and the data lines charging the corresponding odd-number-column pixel electrodes via the corresponding first switching devices under driving control in corresponding time sequence; a plurality of second switching devices, each of which is connected with each even-number-column pixel electrode, and the data lines charging the corresponding even-number-column pixel electrodes via the corresponding second switching devices under driving control in corresponding time sequence, the method comprising:

in a first sequence period, the data lines charging the odd-number-column pixel electrodes in the first row via the corresponding first switching devices under driving control;

in a second sequence period, the data lines charging the even-number-column pixel electrodes in the first row via the corresponding second switching devices under driving control;

in a third sequence period, the data lines charging the odd-number-column pixel electrodes in the second row via the corresponding first switching devices under driving control;

in a fourth sequence period, the data lines charging the even-number-column pixel electrodes in the second row via the corresponding second switching device under driving control;

the odd number pixel electrode and the even number pixel electrodes in the remaining rows being charged in a same way and sequentially, and a charging cycle being completed when the odd-number-column pixel electrodes and the even-number-column pixel electrodes in the last row are charged, wherein each of the first switching device comprising: a first thin film transistor and a second thin film transistor, wherein the gate electrode of the first thin film transistor is connected with a gate line next to the gate line corresponding to the odd-number-column pixel electrode, the source electrode of it is connected with the gate line corresponding to the odd-number-column pixel electrode, and the drain electrode of it is connected with the gate electrode of the second thin film transistor; the gate electrode of the second thin film transistor is connected with the drain electrode of the first thin film transistor, the source electrode of it is connected with the data line corresponding to the odd-number-column pixel electrode, and the drain electrode of it is connected with the odd-number-column pixel electrode; and each of the second switching devices comprises: a third thin film transistor, wherein the gate electrode of the third thin film transistor is connected with the gate line corresponding to the even-number-column pixel electrode, the source electrode of it is connected with the data line corresponding to the even-number-column pixel electrode, and the drain electrode of it is connected with the even-number-column pixel electrode;

wherein in the first sequence period, the gate line corresponding to the first row of pixel electrodes and the gate line corresponding to the second row of the pixel electrodes are in high level, and the other gate lines are in low level, the first, second and third thin film transistors in the first row are turned on, the third thin film transistors in the second row are turned on, the data lines apply pixel signals required by the odd-number-column pixel electrodes in the first row onto the corresponding odd-number-column pixel electrodes in the first row, the even-number-column pixel electrodes in the first and second rows, respectively;

in the second sequence period, the gate line corresponding to the first row of pixel electrodes is at the high level, the other gate lines are at the low level, the third thin film transistors in the first row are turned on, and the data lines apply pixel signals required by the even-number-column pixel electrodes in the first row onto the corresponding even-number-column pixel electrodes in the first row, respectively;

in the third sequence period, the gate line corresponding to the second row of pixel electrodes and the gate line corresponding to the third row of pixel electrodes are at the high level, the other gate lines are at the low level, the first, second and third thin film transistors in the second row are turned on, the third thin film transistors in the third row are turned on, the data lines apply pixel signals required by the odd-number-column pixel electrodes in the second row onto the corresponding odd-number-column pixel electrodes in the second row, the even-number-column pixel electrodes in the second and third rows, respectively; and in the fourth sequence period, the gate line corresponding to the second row of pixel electrodes is at the high level, the other gate lines are at the low level, the third thin film transistors in the second row are turned on, and the data lines apply pixel signals required by the even-number-column pixel electrodes in the second row onto the even-number-column pixel electrodes in the second row, respectively.

2. A driving method for an array substrate, the array substrate comprising a base substrate; an array of pixel electrodes formed on the base substrate; a plurality of gate lines, each of which is formed corresponding to each row of pixel electrodes; a plurality of data lines, each of which is formed corresponding to each odd number column of pixel electrodes and the next adjacent even number column of pixel electrodes; a plurality of first switching devices, each of which is connected with each odd-number-column pixel electrode, and the data lines charging the corresponding odd-number-column pixel electrodes via the corresponding first switching devices under driving control in corresponding time sequence; a plurality of second switching devices, each of which is connected with each even-number-column pixel electrode, and the data lines charging the corresponding even-number-column pixel electrodes via the corresponding second switching devices under driving control in corresponding time sequence, the method comprising:

in a first sequence period, the data lines charging the even-number-column pixel electrodes in the first row via the corresponding second switching devices under driving control;

in a second sequence period, the data lines charging the odd-number-column pixel electrodes in the first row via the corresponding first switching devices under driving control;

in a third sequence period, the data lines charging the even-number-column pixel electrodes in the second row via the corresponding second switching devices under driving control;

in a fourth sequence period, the data lines charging the odd-number-column pixel electrodes in the second row via the corresponding first switching devices under driving control;

the odd-number-column pixel electrodes and the even-number-column pixel electrodes in the remaining rows being charged in a same way and sequentially, and a charging cycle being completed when the odd-number-column pixel electrodes and the even-number-column pixel electrodes in the last row are charged, wherein each of the first switching devices comprises: a fourth thin film transistor, wherein the gate electrode of the fourth thin film transistor is connected with the gate line corresponding to the odd-number-column pixel electrode, the source electrode of it is connected with the data line corresponding to the odd-number-column pixel electrode, and the drain electrode of it is connected with the odd-number-column pixel electrode;

each of the second switching devices comprises: a fifth thin film transistor and a sixth thin film transistor, wherein the gate electrode of the fifth thin film transistor is connected with a gate line next to the gate line corresponding to the even-number-column pixel electrode, the source electrode of it is connected with the gate line corresponding to the even-number-column pixel electrode, and the drain electrode of it is connected with the gate electrode of the sixth thin film transistor; the gate electrode of the sixth thin film transistor is connected with the drain electrode of the fifth thin film transistor, the source electrode of it is connected with the data line corresponding to the even-number-column pixel electrode, and the drain electrode of it is connected with the even-number-column pixel electrode;

wherein in the first sequence period, the gate line corresponding to the first row of pixel electrodes and the gate line corresponding to the second row of the pixel electrodes are at the high level, and the other gate lines are at the low level, the fourth, fifth and sixth thin film transistors in the first row are turned on, the fourth thin film transistors in the second row are turned on, the data lines apply pixel signals required by the even-number-column pixel electrodes in the first row onto the corresponding even-number-column pixel electrodes in the first row, the odd-number-column pixel electrodes in the first and second rows, respectively;

in the second sequence period, the gate line corresponding to the first row of pixel electrodes is at the high level, the other gate lines are at the low level, the fourth thin film transistors in the first row are turned on, and the data lines apply pixel signals required by the odd-number-column pixel electrodes in the first row onto the corresponding odd-number-column pixel electrodes in the first row, respectively;

in the third sequence period, the gate line corresponding to the second row of pixel electrodes and the gate line corresponding to the third row of pixel electrodes are at the high level, the other gate lines are at the low level, the fourth, fifth and sixth thin film transistors in the second row are turned on, the fourth thin film transistors in the third row are turned on, the data lines apply pixel signals required by the even-number-column pixel electrodes in the second row onto the corresponding even-number-column pixel electrodes in the second row, the odd-number-column pixel electrodes in the second and third rows, respectively; and in the fourth sequence period, the gate line corresponding to the second row of pixel electrodes is at the high level, the other gate lines are at the low level, the fourth thin film transistors in the second row are turned on, and the data lines apply pixel signals required by the odd-number-column pixel electrodes in the second row onto the corresponding odd-number-column pixel electrodes in the second row, respectively.

* * * * *